US005431615A

United States Patent [19]

Correll

[11] Patent Number: 5,431,615

[45] Date of Patent: Jul. 11, 1995

[54] HAND-HELD FITNESS DEVICE FOR PROMOTING EXERCISE

[76] Inventor: Charles D. Correll, 161 Haigler Rd., Lenoir, N.C. 28645

[21] Appl. No.: 102,771

[22] Filed: Aug. 6, 1993

[51] Int. Cl.[6] ..... A63B 21/072

[52] U.S. Cl. ..... 482/108; 446/267

[58] Field of Search ..... 482/93, 106, 108, 109, 482/110, 148; 273/DIG. 24; 40/410, 406, 409; 446/267

[56] References Cited

U.S. PATENT DOCUMENTS

| | | | |
|---|---|---|---|
| 2,644,890 | 7/1953 | Hollihan | 482/108 X |
| 3,311,374 | 3/1967 | Wittenberg et al. | 482/106 |
| 3,334,899 | 8/1967 | Bosko et al. | 482/108 |
| 3,781,007 | 12/1973 | Baker et al. | 482/106 X |
| 4,028,830 | 6/1977 | Ottinger | 40/410 |
| 4,538,806 | 9/1985 | Wilkerson | 482/108 |
| 4,600,974 | 4/1986 | Lew et al. | 362/102 |
| 4,641,445 | 2/1987 | Rossi | 40/410 |
| 4,695,051 | 9/1987 | Jenison | 482/108 |
| 4,913,422 | 4/1990 | Elmore et al. | 482/106 |
| 4,997,184 | 3/1991 | Sherman | 482/108 |
| 5,092,807 | 3/1992 | Lew et al. | 446/267 X |
| 5,195,918 | 3/1993 | Moles | 40/410 X |
| 5,264,267 | 11/1993 | Wang | 446/267 X |
| 5,292,564 | 3/1994 | Lee | 40/406 X |

OTHER PUBLICATIONS

"Make Your Own Tornado" Edmund Scientific 1993 Annual Reference Catalog, p. 188.

"Fascinator Rattle" Toys and Novelties, Mar. 1951, p. 444.

*Primary Examiner*—Richard J. Apley
*Assistant Examiner*—John Mulcahy
*Attorney, Agent, or Firm*—W. Thad Adams, III

[57] ABSTRACT

A hand-held fitness device for promoting exercise includes first and second fluid-containing and transparent body members. A threaded coupling is located between the first and second body members for fluidly connecting the first and second body members. The threaded coupling defines a handle for which the fitness device may be gripped. Colored glitter and foam pellets cooperate with the fluid in the first and second body members to produce a turbulent and varying decorative appearance as the fitness device is manipulated.

9 Claims, 5 Drawing Sheets

HAND-HELD FITNESS DEVICE FOR PROMOTING EXERCISE

TECHNICAL FIELD AND BACKGROUND OF THE INVENTION

This invention relates to a hand-held fitness device for promoting exercise. The invention is useful for all ages, and is particularly designed for exercising the muscles in the arms and upper body. The invention produces a varying decorative appearance when handled, and thus encourages use. Because of its unique and interesting appearance, the invention may be used and sold as a toy for children and adults alike. For some of the elderly and handicapped, the mere handling of the fitness device may be sufficient exercise for strengthening muscles and maintaining proper blood flow.

Exercise and fitness have become quite popular in recent years. Fitness devices, such as hand-held weights and dumbbells, are used in aerobic classes, for jogging or walking, or simply to tone and strengthen muscles in the arms and upper body. Often times, people find it difficult to routinely use a particular fitness device and maintain a regular fitness program. This typically results from boredom. Others are intimated by the idea of using cast-iron weights to strengthen their body. Thus, the present invention provides a fitness device which captures the attention, and which stimulates and encourages its use in exercise.

SUMMARY OF THE INVENTION

Therefore, it is an object of the invention to provide an exercise device which is decorative to encourage handling, and to promote its use in exercise.

It is another object of the invention to provide an exercise device which is hand-held.

It is another object of the invention to provide an exercise device which may be used and sold as a toy for both children and adults.

These and other objects of the present invention are achieved in the preferred embodiments disclosed below by providing a hand-held fitness device for promoting exercise. The fitness device includes first and second fluid-containing and transparent body members. A connecting means is located between the first and second body members for fluidly connecting the first and second body members. The connecting means defines a handle for which the fitness device may be gripped. A decorative means cooperates with the fluid in the first and second body members to produce a turbulent and varying decorative appearance as the fitness device is manipulated.

Preferably, the first and second body members are constructed of a light-weight plastic material.

According to one preferred embodiment of the invention, the first and second body members are substantially spherical.

According to another preferred embodiment of the invention, the first and second body members are substantially cylindrical.

Preferably, the fluid is water.

According to one preferred embodiment of the invention, the decorative means comprises colored glitter.

According to another preferred embodiment of the invention, the decorative means comprises foam pellets.

Preferably, the first and second body members are of a substantially identical shape.

Preferably, the first and second body members are disposed in substantial alignment.

According to one preferred embodiment of the invention, the connecting means comprises a threaded coupling.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
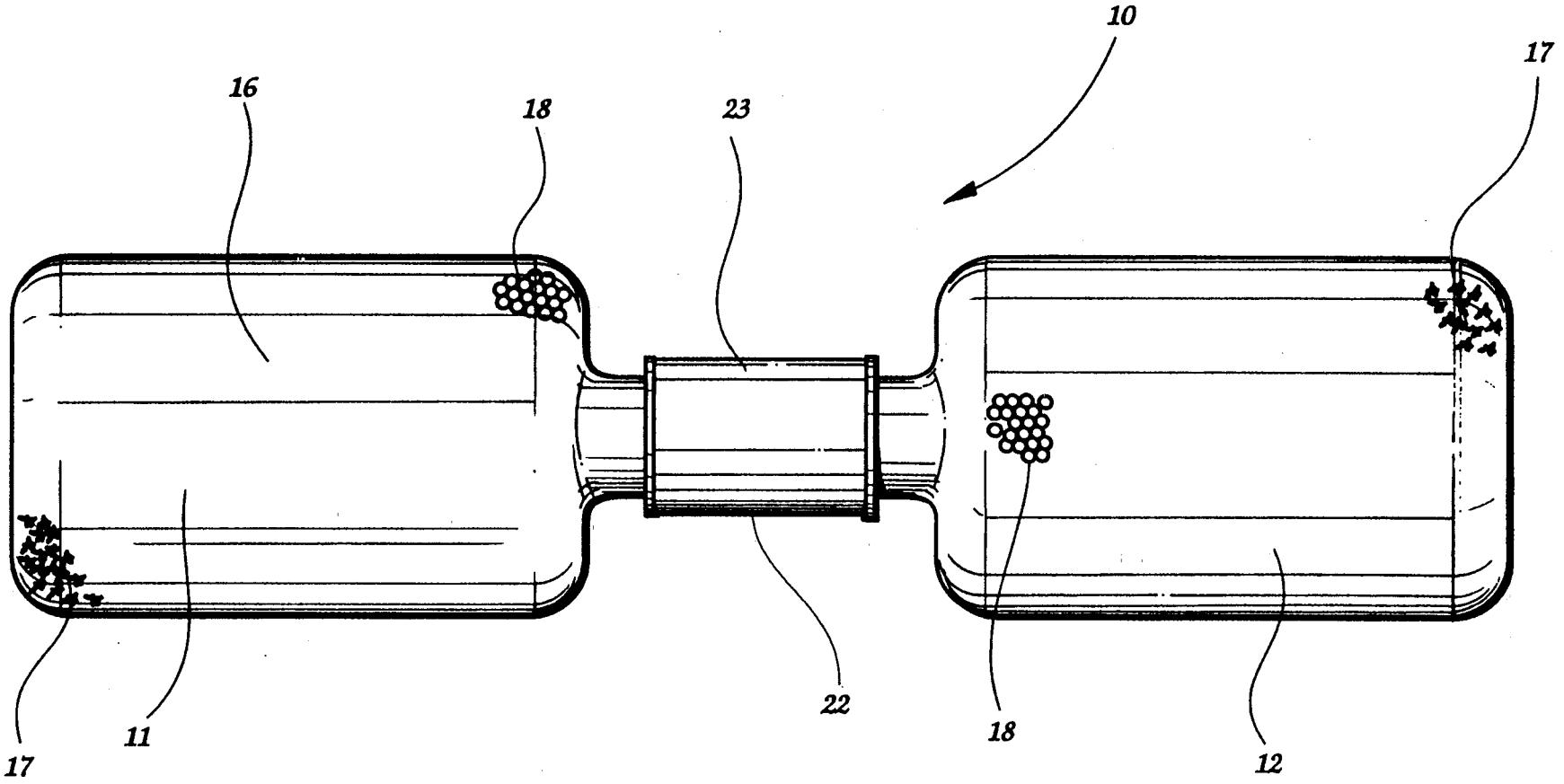
FIG. 1 is a view of the invention according to one preferred embodiment.

Referring now specifically to the drawings, a hand-held fitness device for promoting exercise according to the present invention is illustrated in FIG. 1 and shown generally at reference numeral 10. The fitness device 10 preferably weighs between 1–8 pounds, and may be used to exercise various muscles of the upper body, particularly the arms.

Figure 2:
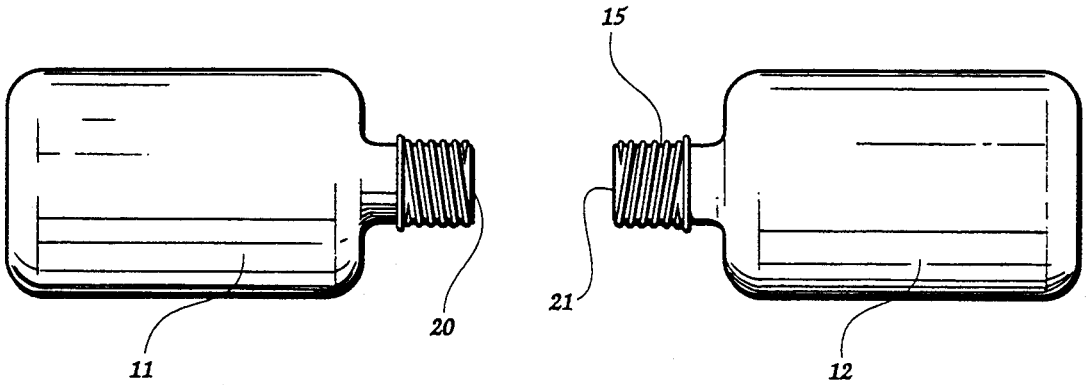
FIG. 2 is a view of the first and second body members shown in FIG. 1, illustrating particularly the threaded neck portion of the respective body members.

The fitness device 10 includes first and second substantially identical and transparent body members 11 and 12 for containing a fluid 16, colored glitter 17, and foam pellets 18. As shown in FIG. 2, each body member 11, 12 includes a respective threaded neck portion 14 and 15 extending to respective openings 20 and 21. According to an alternate embodiment (not shown), the body members 11 and 12 are not substantially identical.

Preferably, a threaded coupling 22 (See FIG. 1) mates with the respective neck portions 14, 15 of the first and second body members 11, 12 to attach the first and second body members 11, 12 to each other. Alternately, the first and second body members 11, 12 may be connected by a "snap-on" coupling, by fusing, or by gluing respective body members 11 and 12 to each other at the periphery of the openings 20 and 21.

Figure 3:
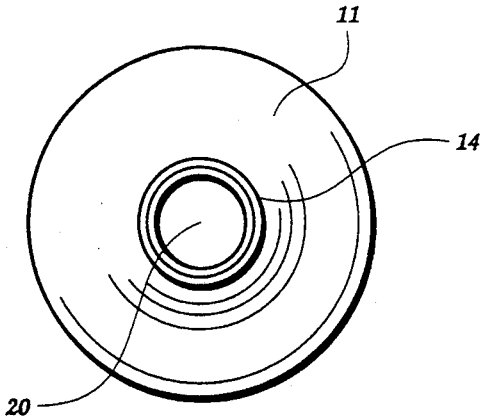
FIG. 3 is a plan view of one body member shown in FIG. 2 illustrating the relative diameters of the body member and opening.

FIG. 3 shows a plan view of the body member 11 illustrating the relative diameters of the neck portion 14 and the body member 11. When assembled, the neck portions 14, 15 and the coupling 22 form a handle 23 for which the fitness device 10 may be handled for exercise.

The fluid 16, colored glitter 17, and foam pellets 18 are inserted through the respective openings 20, 21 in the body members 11, 12 before attachment. As the fitness device 10 is manipulated, the glitter 17 and foam pellets 18 cooperate with the fluid 16 to create a decorative, turbulent array of colors. The resulting appearance of the fitness device 10 captures attention, and encourages handling and exercise. This degree of exercise may be substantial and necessary for maintaining proper blood flow for those who are handicapped, or for the elderly.

Figure 4:
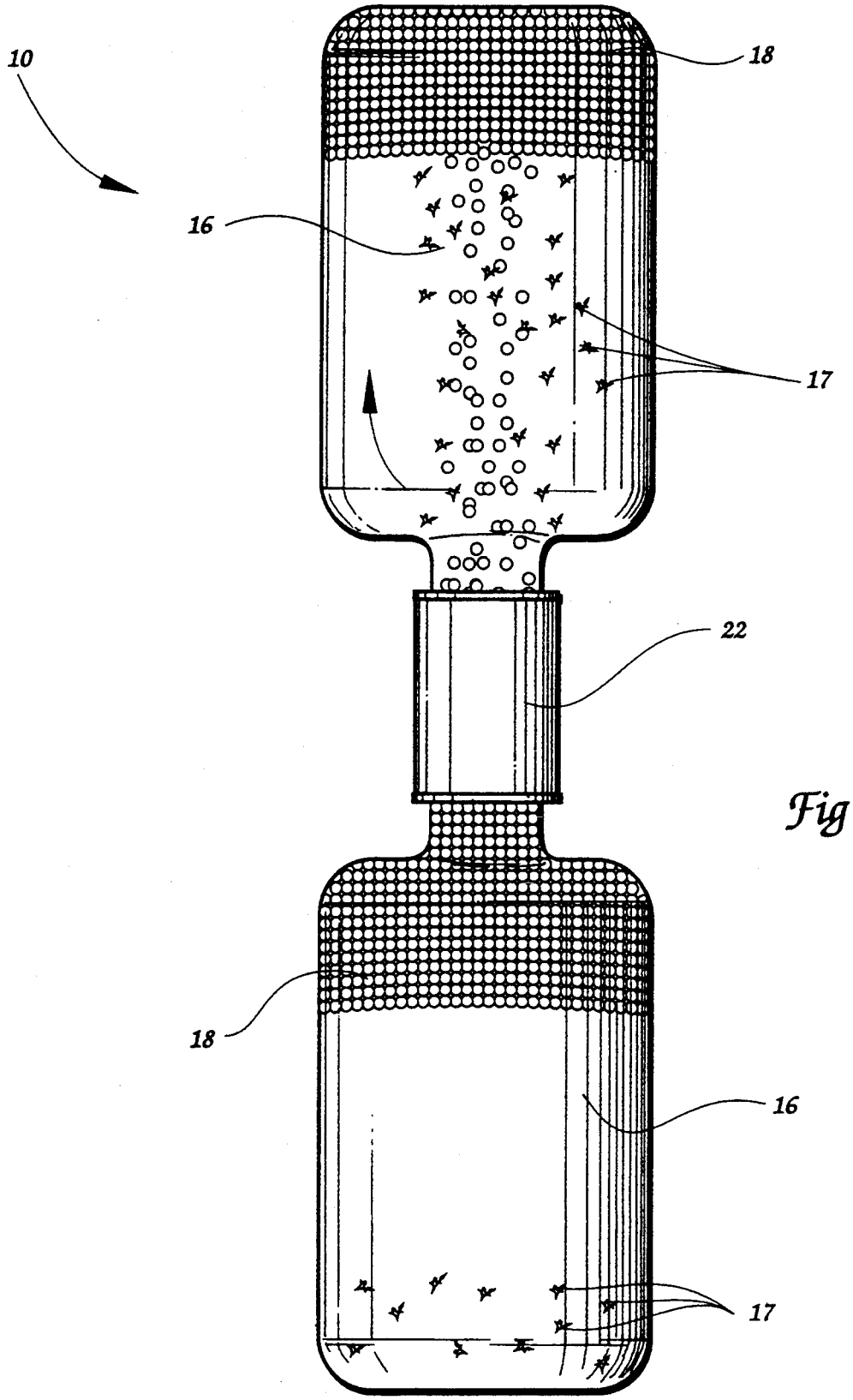
FIG. 4 is a view of the invention substantially inverted to illustrate the movement of foam pellets from the first body member to the upper portion of the second body member.

Preferably, the foam pellets 18 have a density less than the fluid 16. This helps drive the foam pellets 18 from one end of the fitness device 10 through the handle 23 to the opposite end of the fitness device 10 as it is manipulated. As shown in FIG. 4, when wholly or partially inverted, the fitness device acts essentially like an hour glass in reverse, moving foam pellets 18 from the first body member 11 to the upper portion of the second body member 12. Thus, the buoyancy of the foam pellets 18 urges the pellets 18 upwardly from the first body member 11 through the handle 23 to an uppermost portion of the second body member 12 as the fitness device 10 is manipulated to position the second body member 12 above the first body member 11, and upon inverting the fitness device 10 to reverse the position of the first and second body members 11 and 12, the buoyancy of the foam pellets 18 urges the pellets 18 upwardly from the second body member 12 through the handle 23 to an uppermost portion of the first body member 11. The foam pellets 18 are spherical, and are preferably constructed of polystyrene foam. The diameter of the foam pellets 18 may range from 1/16 to ⅛ inch.

The colored glitter 17 preferably comprises bits of torn foil which reflect light. According to one embodiment, the density of the colored glitter 17 is equal to or slightly greater than the fluid 16.

According to one embodiment, the fluid 16 is water. However, other fluids of various densities may be substituted for achieving a similar effect. According to another embodiment of the invention, glycerine is added to the water to provide a higher density fluid 16.

Figure 5:
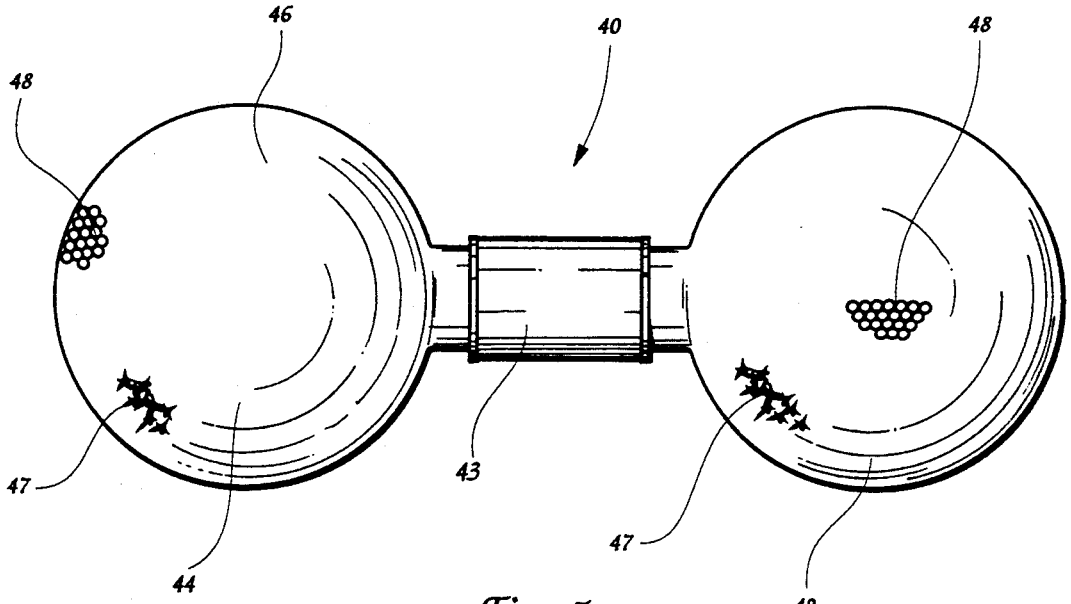
FIG. 5 is a view of the invention according to another preferred embodiment.

The respective body members 11, 12 are preferably constructed of a light-weight plastic material. The body members 11, 12 may be formed of polyester plastic soda bottles with their respective base caps removed. According to the embodiment shown in FIG. 1, the body members 11 and 12 of the fitness device 10 are substantially cylindrical. According to another embodiment shown in FIG. 5, the body members 41 and 42 of the fitness device 40 are substantially spherical. Like fitness device 10, the fitness device 40 includes a threaded coupling 43, fluid 46, colored glitter 47, and foam pellets 48.

Figure 6:
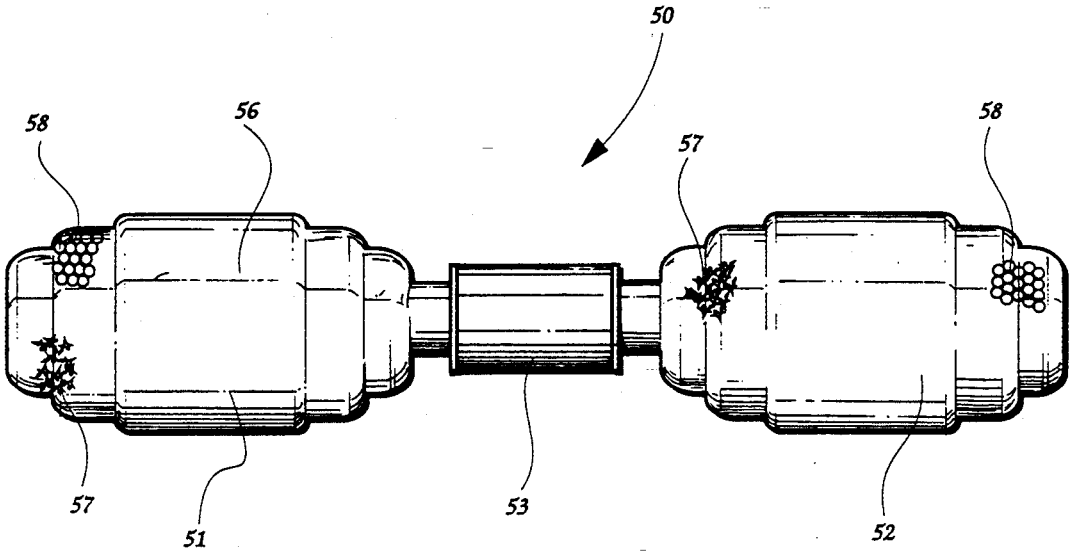
FIG. 6 is a view of the invention according to yet another preferred embodiment.

Other various shapes, such as that illustrated in FIG. 6, may be formed to enhance the overall exercise-stimulating appearance of the fitness device. As shown in FIG. 6, the fitness device 50 has body members 51 and 52 having tapered ridges on each end. Like fitness devices 10 and 40, the fitness device 50 includes a threaded coupling 53, fluid 56, colored glitter 57, and foam pellets 58.

A hand-held fitness device for promoting exercise is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A hand-held fitness device for promoting exercise, comprising:

(a) first and second fluid-containing and transparent body members each said body member having a neck with an opening therein;

(b) connecting means located between said first and second body members for fluidly connecting said necks of said first and second body members, said connecting means defining a handle with which the fitness device may be gripped, said handle defining a lesser volume than said body members; and (c) decorative means including a multiplicity of buoyant, relatively small foam pellets cooperating with the fluid in said first and second body members to produce a turbulent and varying decorative appearance as said fitness device is manipulated, the buoyancy of the foam pellets urging the pellets upwardly from the first body member through the handle to an uppermost portion of the second body member as the fitness device is manipulated to position the second body member above the first body member, and upon inverting the fitness device to reverse the position of the first and second body members, the buoyancy of the foam pellets urging the foam pellets upwardly from the second body member through the handle to an uppermost portion of the first body member.

2. A hand held fitness device according to claim 1, wherein said first and second body members are constructed of a light-weight plastic material.

3. A hand-held fitness device according to claim 2, wherein said first and second body members are substantially spherical.

4. A hand-held fitness device according to claim 2, wherein said first and second body members are substantially cylindrical.

5. A hand-held fitness device according to claim 1, wherein the fluid is water.

6. A hand-held fitness device according to claim 1, wherein said decorative means comprises colored glitter.

7. A hand-held fitness device according to claim 1, wherein said first and second body members are of a substantially identical shape.

8. A hand-held fitness device according to claim 1, wherein said first and second body members are disposed in substantial alignment.

9. A hand-held fitness device according to claim 1, wherein said connecting means comprises a threaded coupling.

* * * * *